United States Patent [19]

Nagai

[11] Patent Number: 4,823,270

[45] Date of Patent: Apr. 18, 1989

[54] METHOD AND APPARATUS FOR CONTROLLING AIR-FUEL RATIO IN INTERNAL COMBUSTION ENGINE

[75] Inventor: Toshinari Nagai, Susono, Japan

[73] Assignee: Toyota Jidosha Kabushiki Kaisha, Toyota, Japan

[21] Appl. No.: 927,589

[22] Filed: Nov. 6, 1986

[30] Foreign Application Priority Data

Nov. 9, 1985 [JP] Japan ..... 60-249967

[51] Int. Cl.[4] ..... F02M 51/00

[52] U.S. Cl. ..... 364/431.05; 123/489; 123/440; 73/118.2

[58] Field of Search ..... 304/431.03, 431.05; 123/489, 440, 391, 344; 73/117.3, 118.2

[56] References Cited

U.S. PATENT DOCUMENTS 4,517,949 5/1985 Ito et al. ..... 123/489
4,535,736 8/1985 Taura et al. ..... 364/431.05 X
4,625,699 12/1986 Kabayashi et al. ..... 123/489
4,638,658 1/1987 Otobe ..... 123/440
4,655,188 4/1987 Tomisawa et al. ..... 123/489
4,664,086 5/1987 Takeda et al. ..... 123/489
4,707,985 11/1987 Nagai et al. ..... 60/276 X

*Primary Examiner*—Parshotam S. Lall
*Assistant Examiner*—V. N. Trans
*Attorney, Agent, or Firm*—Cushman, Darby & Cushman

[57] ABSTRACT

In an internal combustion engine having an air-fuel ratio sensor in an exhaust pipe thereof and a signal processing circuit for an output of the air-fuel ratio sensor, a air-fuel ratio correction amount is regulated within a range defined by a lower limit value and a upper limit value, and the air-fuel ratio of the engine is adjusted by the air-fuel ratio correction amount, and one of the limit values is varied in accordance with a running state parameter of the engine.

16 Claims, 15 Drawing Sheets

CASTA
a
0

FAF
RFB
c
b
1.0
d
RFB
PRIOR ART
FAF
PRESENT INVENTION
LFB
LOWER LIMIT OF GUARD VALUE

Ox
RICH
LEAN

A/F
RICH
1.0
LEAN
PRIOR ART
PRESENT INVENTION

ELEMENT TEMP. OF O2SENSOR
HIGH
LOW
ACTIVE STATE
INACTIVE STATE

Ne
HIGH
a
LOW
t0
START-UP
t1
t2
t3
t4
t5
t6
TIME

CASTA
α
0

FAF
RFB
c
h
b
1.0
d
RFB
PRIOR ART
FAF
PRESENT INVENTION

Ox
RICH
LEAN
LOWER LIMIT OF GUARD VALUE

A/F
RICH
10
LEAN
PRIOR ART
PRESENT INVENTION

ELEMENT TEMP. OF O2 SENSOR
HIGH
LOW
ACTIVE STATE
INACTIVE STATE

Ne
HIGH
a
LOW

CLCX
e
0

LEARNING CONTROL
PROHIBIT
EXECUTION
PROHIBIT
EXECUTION
t0 t1 t2 t3 t4 t5 t6 t7 t8 t9 t10 TIME
START-UP

METHOD AND APPARATUS FOR CONTROLLING AIR-FUEL RATIO IN INTERNAL COMBUSTION ENGINE

BACKGROUND OF THE INVENTION

1. Field of the Invention

The present invention relates to a method and apparatus for feedback control of the air-fuel ratio in an internal combustion engine by an output signal from an $O_2$ sensor which measures the oxygen density of an exhaust gas discharged from the engine.

2. Description of the Related Art

At present, a three-way catalyzer is used to convert three noxious gas components contained in an exhaust gas of an engine into innocuous gas components. Namely, noxious carbon monoxide (CO) and hydrocarbon (HC) are oxidized and nitrogen oxides ($NO_X$) are deoxidized simultaneously by the three-way catalyzer into carbon dioxide ($CO_2$), water vapor ($H_2O$), and nitrogen ($N_2$) respectively. It is known that the cleaning capacity of the three-way catalyzer is greatly affected by an air-fuel ratio set for the engine. When the air-fuel ratio is lean, the amount of oxygen ($O_2$) in the exhaust gas is increased to increase the oxidizing action and reduce the deoxidizing action. On the contrary, when the air-fuel ratio is rich, the oxidizing action may be reduced and the deoxidizing action increased. At a stoichiometric air-fuel ratio, the oxidizing and deoxidizing actions are balanced to enable a most efficient operation of the three-way catalyzer.

To improve the cleaning efficiency of the three-way catalyzer, an air-fuel ratio feedback control system is widely adopted in which an $O_2$ sensor is used for detecting a residual oxygen density in an exhaust gas, to estimate an air-fuel ratio and to bring the air-fuel ratio close to the stoichiometric air-fuel ratio. In the prior air-fuel ratio feedback control system, the $O_2$ sensor is arranged in an exhaust system located close to a combustion chamber of an engine, i.e., the sensor is positioned at the gathering point of an exhaust manifold located upstream the three-way catalyzer.

A characteristic of the $O_2$ sensor is that, when exposed to a low temperature atmosphere, the output of the sensor gradually decreases until eventually the sensor becomes inactive. Namely, when the engine is in an idling state, the temperature of an exhaust gas discharged from the engine drops, and, therefore, the timing of the inversion of an air-fuel ratio signal from the $O_2$ sensor is gradually displaced from a timing corresponding to the stoichiometric air-fuel ratio, and accordingly, the air-fuel ratio is not maintained at the stoichiometric air-fuel ratio. As a result, the idling operation becomes rough and the quality of emissions in the idling state is deteriorated. (A countermeasure to cope with an error caused in the air-fuel ratio feedback control system when the engine is in an idle state for a long time and the $O_2$ sensor is cooled, is disclosed in Japanese Patent Publication No. 56-7051.)

Recently, engines tend to be high-powered, and when the engine is operated at a high load, the temperature of the exhaust gas from the engine becomes high, and thus increases the thermal load applied to the $O_2$ sensor arranged at the exhaust manifold. This causes another problem in that the $O_2$ sensor is soon damaged.

To reduce the thermal load of the $O_2$ sensor, it has been proposed to fit the $O_2$ sensor downstream of the exhaust manifold, for example, at an exhaust pipe.

If the $O_2$ sensor is provided downstream of the exhaust manifold, such as at an exhaust pipe as mentioned above, the $O_2$ sensor is cooled not only in an idling state but also in a normal running state (particularly, when a vehicle is running in an urban area or is decelerating) so that the $O_2$ sensor may be cooled to a temperature at which it becomes inactive. As a result, errors such as an erroneous control of the air-fuel ratio feedback and an erroneous learning in a base air-fuel ratio learning control, will occur more often, to deteriorate the emissions, fuel consumption, and driveability. This will be described later in detail.

SUMMARY OF THE INVENTION

It is an object of the present invention to provide a method and an apparatus for adjusting an air-fuel ratio by using an air-fuel ratio sensor such as an $O_2$ sensor to improve the emissions, fuel consumption, and driveability.

According to the present invention, an air-fuel ratio correction coefficient "FAF" for correcting the air-fuel ratio of an engine is calculated according to an output signal from an air-fuel ratio sensor such as an $O_2$ sensor.

Where a flow-out type signal processing circuit is adopted for the air-fuel ratio sensor, a lower limit value of the air-fuel ratio correction coefficient FAF is obtained according to engine operation parameters, and the air-fuel ratio correction coefficient FAF is corrected such that the coefficient FAF will be in a range up to the lower limit value. As a result, the air-fuel ratio of the engine is adjusted according to the corrected air-fuel ratio correction coefficient FAF so that an erroneous feedback control (erroneous feedback correction) will be prevented, which otherwise will occur when the sensor located in an exhaust passage of the engine is cooled and becomes inactive because of certain engine operating conditions. As a result, the emission, fuel consumption, and driveability of the engine will be improved. When a flow-in type signal processing circuit is adopted for the air-fuel ratio sensor, an upper limit value of the air-fuel ratio correction coefficient FAF is obtained, and the coefficient FAF is controlled to be in a range up to the upper limit value.

BRIEF DESCRIPTION OF THE DRAWINGS

These and other objects and features of the present invention will become apparent from the following description with reference to the accompanying drawings, in which.

DESCRIPTION OF THE PREFERRED EMBODIMENTS

Figure 1:
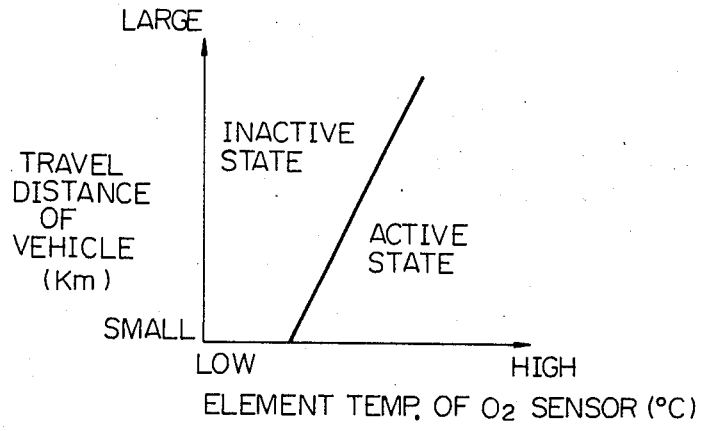
FIG. 1 is a graph showing an $O_2$ sensor change due to the change of the temperature of the $O_2$ sensor according to a distance traveled by a vehicle.

FIG. 1 is a graph showing that the active and inactive states of an $O_2$ sensor change due to the change of the temperature of the $O_2$ sensor according to the distance traveled by a vehicle. From this figure, it will be understood that a temperature at which the $O_2$ sensor becomes active, which is generally 300° C. to 450° C., and an inactive area of the sensor are gradually increased as the travel distance increases.

Figure 2:
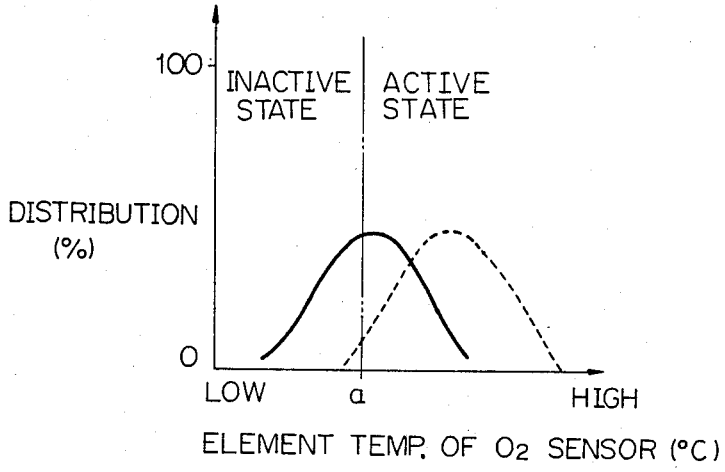
FIG. 2 is a graph showing the distribution characteristic of the temperature of the $O_2$ sensor while the vehicle is running in an urban area.

FIG. 2 is a graph showing the distribution of the temperature of the $O_2$ sensor measured while the vehicle is running in an urban area. The axis of the abscissa represents the temperature of the $O_2$ sensor in which an active state initiating temperature is indicated by "a", and the axis of the ordinate represents a distribution of temperature which have been sampled at fixed time intervals. A dash line in the figure indicates a case in which the $O_2$ sensor is fitted to an exhaust manifold, and a continuous line indicates a case in which the $O_2$ sensor is fitted to an exhaust pipe. It will be understood from the figure that the $O_2$ sensor rarely becomes inactive even if the vehicle runs in an urban area (in a heavy traffic area) when the $O_2$ sensor is fitted to the exhaust manifold, but that the $O_2$ sensor is frequently inactivated if the $O_2$ sensor is fitted to the exhaust pipe. A new $O_2$ sensor was used in this test. If the $O_2$ sensor of a vehicle which has traveled for a long distance is used in the test, the $O_2$ sensor will be more frequently inactivated because the activation initiating temperature (indicated by "a" in the figure) is moved toward a high temperature side in FIG. 2.

Figure 3:
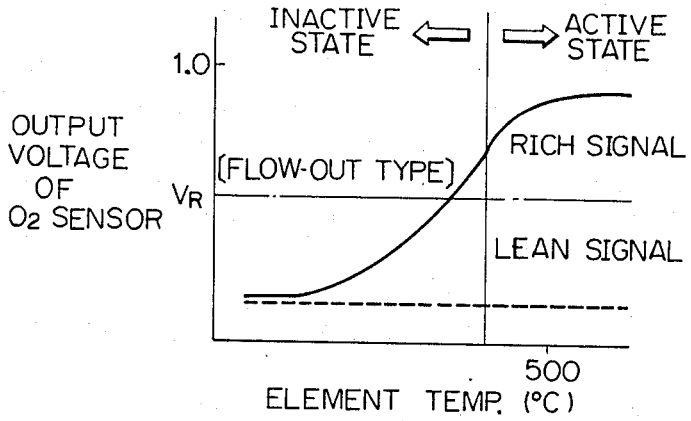
FIG. 3 is a graph showing the output characteristic of a flow-out type output processing circuit adopted for the $O_2$ sensor.
Figure 4:
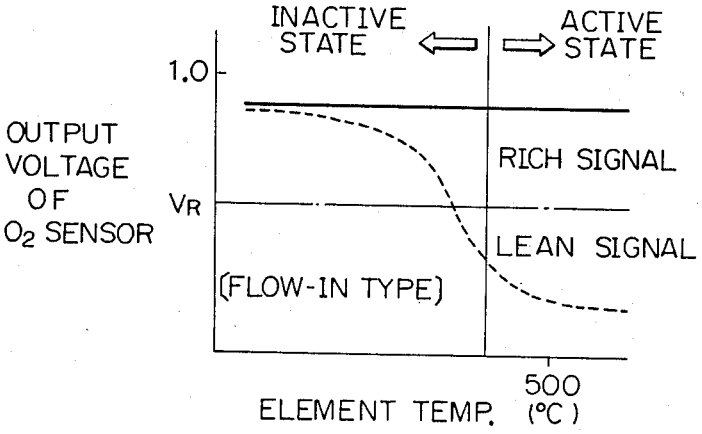
FIG. 4 is a graph showing the output characteristic of a flow-in type output processing circuit adopted for the $O_2$ sensor.
Figures 5A, 5B, 5C, 5D:
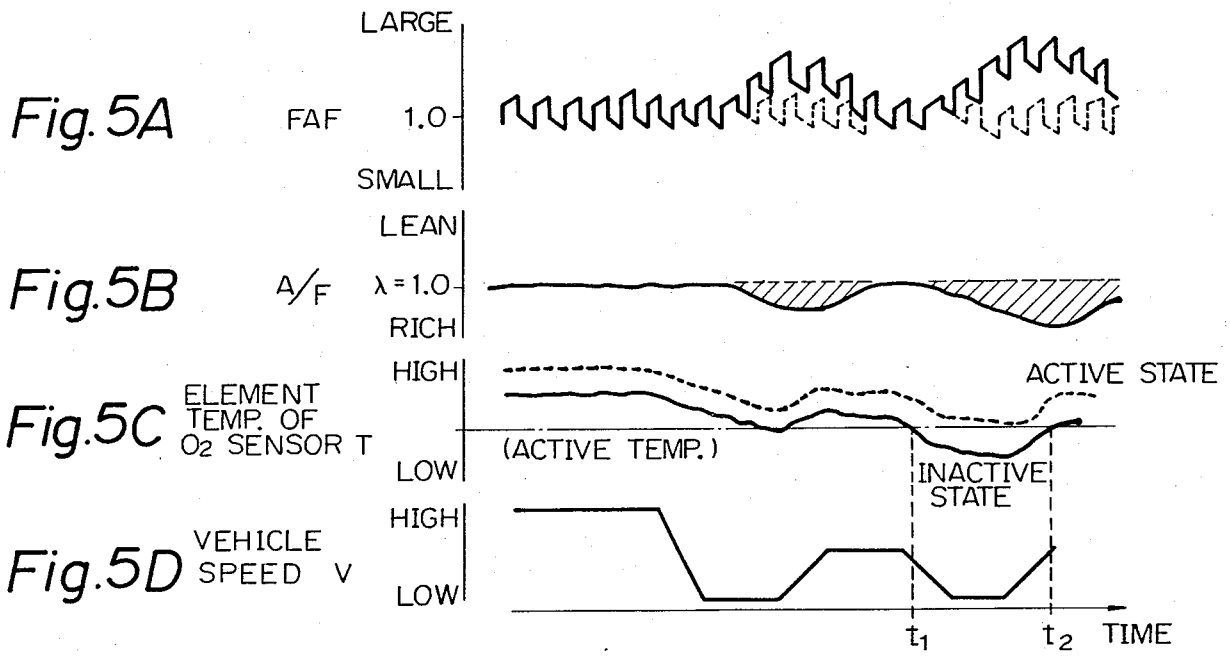
FIGS. 5A, 5B, 5C, and 5D are diagrams showing changes in an air-fuel ratio correction coefficient, in an air-fuel ratio, in the temperature of the $O_2$ sensor, and in a vehicle speed with respect to a period in which the vehicle provided with the $O_2$ sensor having the flow-out type output processing circuit is repeatedly driven and stopped at a high speed.

The relationship between the temperature of the $O_2$ sensor, an output signal of the $O_2$ sensor, and a controlled air-fuel ratio will be described. Circuits for processing the output signal of the $O_2$ sensor are usually categorized as a flow-out type, the output characteristic of which is shown in FIG. 3, and a flow-in type, the output characteristic of which is shown in FIG. 4. When the $O_2$ sensor is in an active state, the flow-out type circuit and the flow-in type circuit generate outputs of substantially the same level according to whether the air-fuel ratio is rich or lean, but when the $O_2$ sensor is in an inactive state, the flow-out type circuit generates a low level output and the flow-in type circuit generates a high level output. The following explanation will be made for the flow-out type circuit shown in FIG. 3. It will be seen in the figure that the $O_2$ sensor with the flow-out type circuit generates a lean output even if an air-fuel ratio state is rich when the $O_2$ sensor is inactive.

FIGS. 5A, 5B, 5C and 5D are diagrams showing an air-fuel ratio correction coefficient FAF, an air-fuel ratio A/F, and a temperature T of the $O_2$ sensor when a vehicle with an $O_2$ sensor provided with a flow-out type output processing circuit is repeatedly run and stopped at a high speed, and comparing a case in which the $O_2$ sensor is fitted to an exhaust manifold (upstream), shown by a dash line, with a case in which the $O_2$ sensor is fitted to an exhaust pipe (relatively downstream), shown by a continuous line.

When the $O_2$ sensor is fitted to the exhaust manifold, the $O_2$ sensor will never become inactive because of the temperature, so that the air-fuel ratio A/F is always controlled to a stoichiometric air-fuel ratio in which an excess air factor $\lambda$ is 1.0. But, when the $O_2$ sensor is fitted to the exhaust pipe, the $O_2$ sensor will become inactive if a vehicle speed V is reduced in an interval from a time $t_1$ to a time $t_2$. At this time, the $O_2$ sensor cannot correctly detect an actual air-fuel ratio, and an output of the $O_2$ sensor will be low level, indicating a lean state. Since the A/F ratio correction is carried out according to this result, the air-fuel ratio becomes richer than the stoichiometric air-fuel ratio, and thus the emission and fuel consumption are deteriorated.

Figure 6:
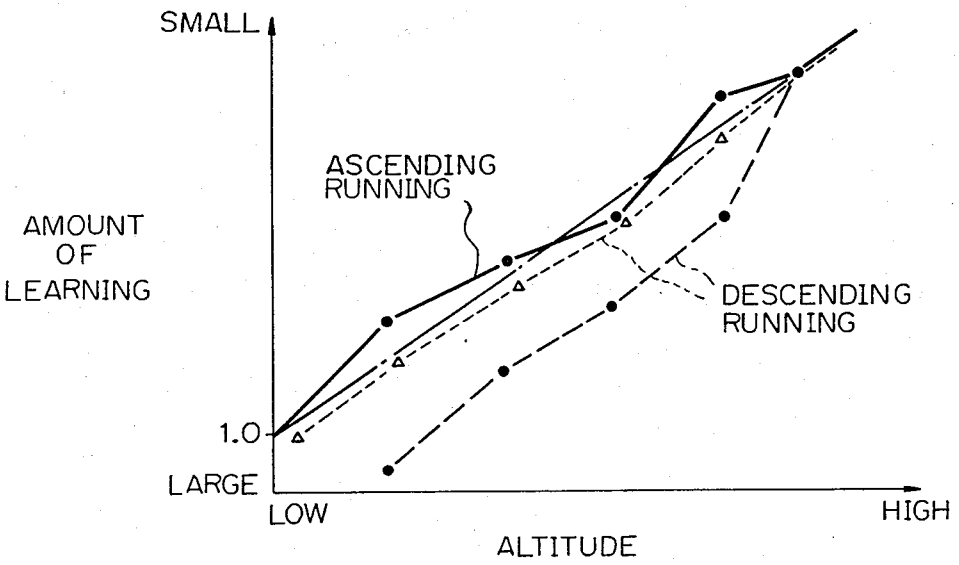
FIG. 6 is a graph showing changes in a theoretical learning quantity and in an actual learning quantity when the vehicle ascends and descends a slope with respect to the fitting positions of the $O_2$ sensor.

If a base air-fuel ratio learning control is carried out to correct a base air-fuel ratio such that an average level of the air-fuel ratio correction coefficient FAF is converged to a reference value, an erroneous learning control tends to occur because of the above-mentioned erroneous correction control. For example, if the vehicle goes from a low altitude to a high altitude, and vice versa, the higher the altitude the thinner the air. Therefore, the amount of fuel to be supplied must be reduced as the vehicle climbs higher, and a learning quantity must be changed as shown by a long and short dot line in FIG. 6. Since the engine is operated under a high load when the vehicle is climbing, the $O_2$ sensor will be in a sufficiently active state. At this time, the learning quantity substantially coincides with a continuous line in FIG. 6 irrespective of whether the $O_2$ sensor is fitted to the exhaust manifold or to the exhaust pipe. But, when the vehicle descends, the learning quantity will be substantially the same as shown by a dot line in FIG. 6, only when the $O_2$ sensor is fitted to the exhaust manifold. If the $O_2$ sensor is fitted to the exhaust pipe, the $O_2$ sensor will be in an inactive state and will output a lean signal, and the air-fuel ratio correction coefficient FAF will become large so that the learning quantity is on the rich side, as indicated by a dash line in FIG. 6, and thus the fuel consumption and emission will deteriorate.

As described above, when the $O_2$ sensor is fitted to the exhaust pipe instead of the exhaust manifold, the $O_2$ sensor becomes inactive state not only when the engine is idling state but also during a low speed and low load running of the engine. The prior art technique cannot prevent such an erroneous feedback control and erroneous learning control, and thus allows a deterioration of the fuel consumption, emission, and driveability.

Figure 7:
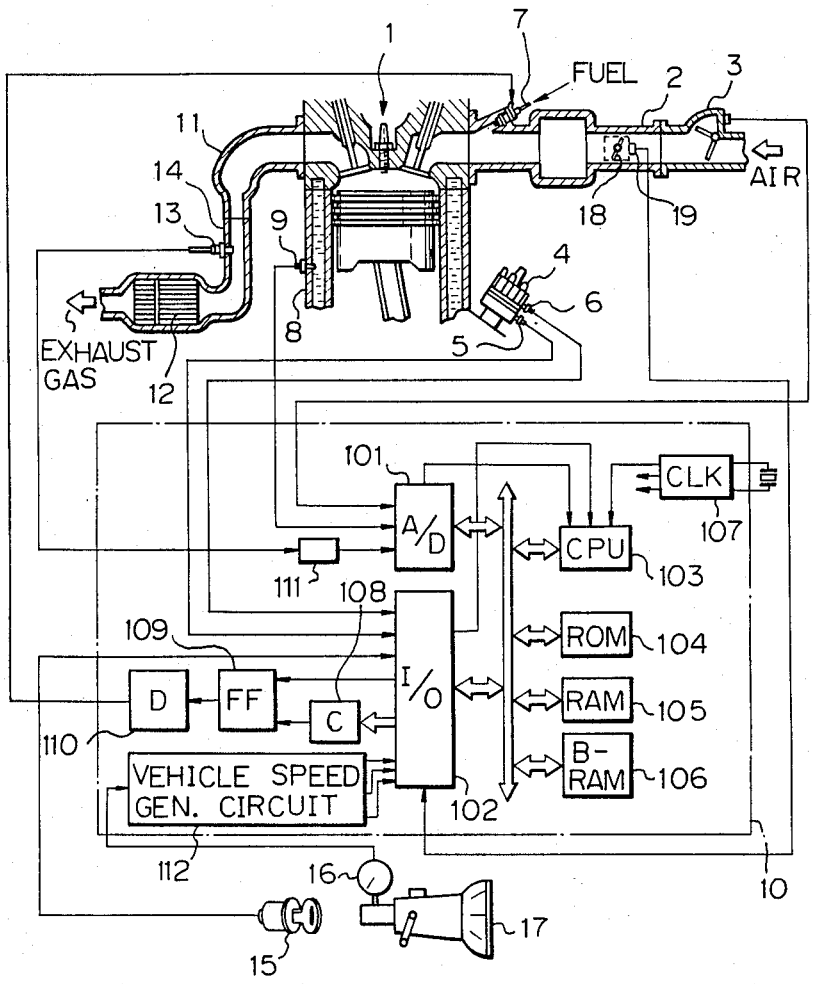
FIG. 7 is a schematic diagram of an embodiment of an air-fuel control system according to the present invention.

FIG. 7 is a general schematic diagram showing an embodiment of an air-fuel control system according to the present invention. In the figure, an air-intake passage 2 of an engine 1 is provided with an airflow meter 3 for directly measuring an amount of air taken into the engine 1. The airflow meter 3 incorporates a potentiometer which generates an output signal of an analog voltage proportional to the amount of intake air. The output signal is supplied to an A/D converter 101, which incorporates a multiplexer, of a controlling circuit 10. A distributor 4 is provided with a crank angle sensor 5 and a crank angle sensor 6. The crank angle sensor 5 generates a pulse signal at every 720° crank angle (CA) to detect a reference position, and the crank angle sensor 6 generates a pulse signal at every 30° crank angle to detect the reference position. The pulse signals of the crank angle sensors 5 and 6 are supplied to an I/O interface 102 of the controlling circuit 10, and the output signal of the crank angle sensor 6 is then supplied to an interrupt terminal of a CPU 103.

The air-intake passage 2 is further provided with a fuel injection valve 7 for supplying pressurized fuel from a fuel supply system to a suction port at each engine cylinder.

A water jacket of a cylinder block of the engine 1 is provided with a water temperature sensor 9 for detecting the temperature of the engine coolant. The water temperature sensor 9 generates an electric signal of an analog voltage corresponding to the temperature THW of the engine coolant. This output signal is supplied to the A/D converter 101.

A three-way catalyzer 12 is fitted to an exhaust system at a location downstream of an exhaust manifold 11. The three-way catalyzer 12 simultaneously removes three noxious components HC, CO, and $NO_X$ contained in an exhaust gas.

An $O_2$ sensor 13, which is a kind of air-fuel ratio sensor, is fitted to an exhaust pipe 14 at a position downstream of the exhaust manifold 11 and upstream of the three-way catalyzer 12. The $O_2$ sensor 13 generates an electric signal in response to the density of an oxygen component in the exhaust gas. Namely, the $O_2$ sensor 13 generates a different output voltage signal depending on whether the air-fuel ratio is on a lean side or on a rich side with respect to a stoichiometric air-fuel ratio, and the output voltage signal is transferred to the A/D converter 101 through a signal processing circuit 111 of the controlling circuit 10.

An ON/OFF signal for a starter is supplied from a key switch 15 to the I/O interface 102. A vehicle speed sensor 16 is connected to a speed meter cable extending from a transmission 17 and generates pulse signals proportional to the vehicle speed. The pulse signals from the vehicle speed sensor 16 are supplied to a vehicle speed defining circuit 112 of the controlling circuit 10. The vehicle speed defining circuit 112 comprises a counter which supplies vehicle speed data in binary digits to the I/O interface 102 for a fixed gate time.

An idle switch 19 is arranged for a throttle valve 18 disposed in the air-intake passage 2 to detect whether or not an opening of the throttle valve 18 is zero. An output signal from the idle switch 19 is supplied to the I/O interface 102 of the controlling circuit 10.

Figure 8A:
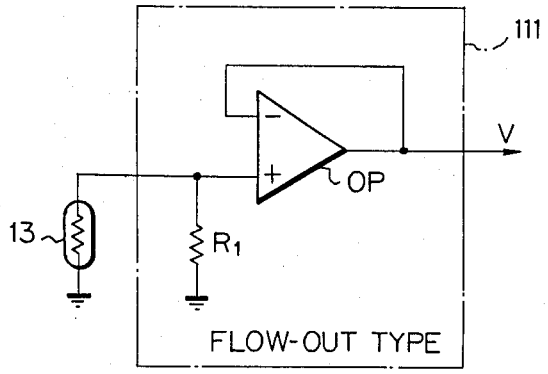
FIGS. 8A and 8B are circuit diagrams of a signal processing circuit shown in FIG. 7.

As described before, two types of the signal processing circuit 111 are available, i.e., a flow-out type circuit and a flow-in type circuit. As shown in FIG. 8A, the flow-out type circuit comprises a grounded resistor R1 and a buffer OP. When the $O_2$ sensor 13 is in an inactive state, an output voltage of the flow-out type circuit disappears. As a result, due to a sink current flowing through the resistor R1, an input to the signal processing circuit 111 will be low level irrespective of the active state or the inactive state, and thus the output V will be low level. Namely, as shown in FIG. 8A, by confirming the existence of a high level signal (rich signal in an active state), the active state of the $O_2$ sensor can be determined.

Figure 8B:
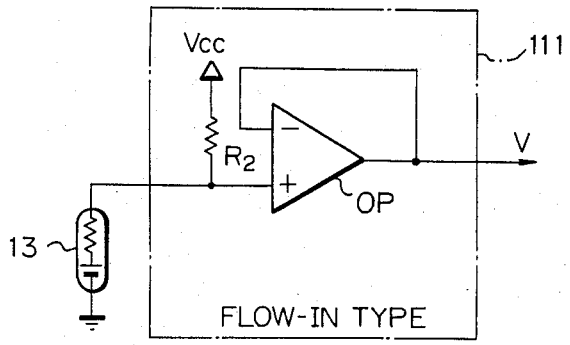

On the other hand, the flow-in type circuit shown in FIG. 8B comprises a resistor R2 connected to a power source $V_{cc}$ and a buffer OP. If the $O_2$ sensor is in an inactive state, an output voltage of the flow-in type circuit disappears. As a result, due to a source current flowing from the power source $V_{cc}$ to the resistor R2, an input to the signal processing circuit 111 will be high level irrespective of the active or the inactive state, and thus the output V will be high level. Namely, as shown in FIG. 8B, by confirming the existence of a low level signal (lean signal in an active state), the active state of the $O_2$ sensor can be determined.

The flow-out type circuit is used as the signal processing circuit 111 in the following description.

The controlling circuit 10, which may be constructed by a microcomputer, further comprises a read-only memory (ROM) 104, a random access memory (RAM) 105, a backup RAM 106, a clock generating circuit 107, etc.

In the controlling circuit 10, a down counter 108, a flip-flop 109, and a running circuit 110 are used to control the fuel injection valve 7. When a fuel injection amount TAU is calculated in a routine to be described later, the fuel injection amount TAU is preset in the down counter 108, and the flip-flop 109 is simultaneously set. As a result, the running circuit 110 activates the fuel injection valve 7. On the other hand, the down counter 108 counts the clock signals (not shown) from the clock generator 107, and when a carry-out terminal of the counter 108 becomes level "1", the flip-flop 109 is reset, and the running circuit 110 stops the activation of the fuel injection valve 7. Namely, the fuel injection valve 7 is activated for the fuel injection amount TAU so that a fuel corresponding to the fuel injection amount TAU may be fed to a combustion chamber of the engine 1.

Interruptions to the CPU 103 occur when the A/D converter 101 completes an A/D conversion, when the I/O interface 102 receives a pulse signal from the crank angle sensor 6, and when an interruption signal is received from the clock generating circuit 107, etc.

An intake air amount data Q of the airflow meter 3 and the cooling water temperature data THW are taken up by an A/D conversion routine, which is carried out at fixed times, and stored in a predetermined region of the RAM 105. Namely, the data Q and THW are renewed with predetermined time intervals. The engine rotational speed Ne is calculated according to an interruption signal generated at every 30° crank angle by the crank angle sensor 6, and stored in a predetermined region of the RAM 105.

The operation of the controlling circuit shown in FIG. 7 will now be described.

Figure 9:
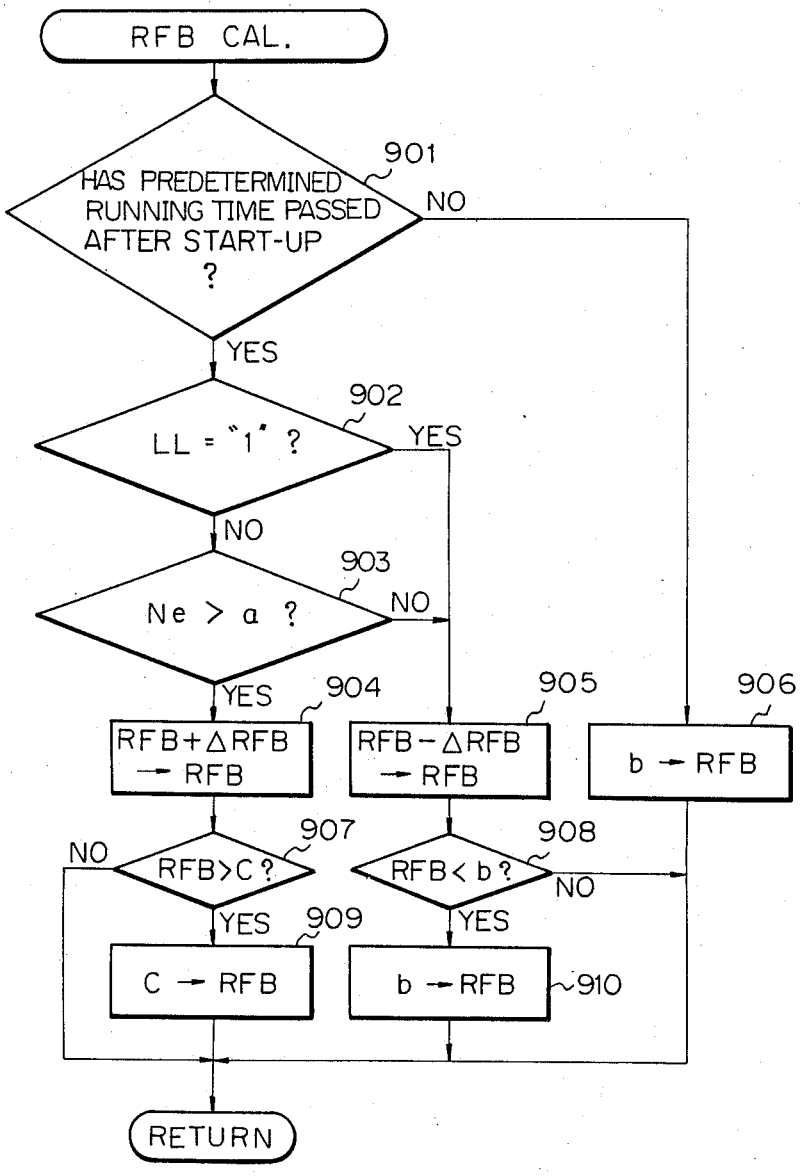
FIGS. 9, 10, 11, 12, 14, 15, and 16 are flowcharts showing the operation of the control system shown in FIG. 7.

FIG. 9 shows a routine for estimating the temperature of the $O_2$ sensor, which is used as a air-fuel ratio sensor, according to the operating time and conditions of the engine, and for preventing an erroneous control (erroneous correction of error) in the feedback control by guarding the air-fuel ratio correction coefficient FAF with a guard value RFB when the $O_2$ sensor reaches a inactive temperature at which it becomes inactive.

At step 901 of the routine shown in FIG. 9, it is determined whether or not the vehicle has run for a predetermined time α after the start-up of the engine. The details of a routine for calculating the running period time will be described later. This determination is carried out is because, although the engine has been started, the temperature of the $O_2$ sensor will not rise to an active temperature when the engine is left in an idling state, and to discriminate the active state of the $O_2$ sensor according to the running time after the start-up of the engine.

If the running time is short, i.e., if a count value CASTA for the running time is smaller than α at step 901, the routine proceeds to step 906 in which a guard value RFB, which is on a rich side when the flow-out type circuit is adopted as this embodiment, of the air-fuel ratio correction coefficient FAF is set to a fixed value "b". Preferably, the fixed value "b" is set to 1.01 to 1.05.

If the vehicle has been driven for more than the fixed time α at step 901, the routine proceeds to step 902 in which it is determined whether the idle switch 19 is ON, i.e. LL="1"?. If LL="1" (YES), the operation proceeds to step 905 in which the guard value RFB is gradually reduced to prevent an erroneous control when the temperature of the $O_2$ sensor drops because the vehicle is in an idling state, in a climbing state, or in a deceleration state.

Although the idle switch 19 has been used to determine the low load running condition in the above embodiment, it is also possible to use an intake-air pressure PM, the engine rotational speed Ne multiplied by the intake-air amount Q, and a throttle opening TA to perform the same determination.

If LL="0" at step 902, the idle switch 19 is OFF and the operation proceeds to step 903, in which it is determined whether or not the engine rotational speed Ne is greater than a fixed value "a". If the engine rotational speed Ne is smaller than "a", the operation proceeds to step 905 in which the guard value RFB is gradually reduced. If the engine rotational speed Ne is greater than "a" at step 903, the operation proceeds to step 904 in which the guard value RFB is gradually increased. The reference value "a" is 1000 to 2000 rpm.

Although the guard value RFB has been reduced or increased in response only to the engine rotational speed Ne in the above embodiment, the reduction or the increment may be carried out in response to the intake-air amount Q, intake-air pressure PM, vehicle speed SPD, and throttle opening TA.

After increasing the guard value RFB at step 904, the routine proceeds to step 907 in which it is determined whether or not the guard value RFB exceeds a maximum value C (C=1.15 to 1.25, approximately). If "YES", the routine proceeds to step 909 in which the current guard value RFB is set as the maximum value C. Similar to the above, the guard value RFB which has been reduced at step 905 is determined at step 908 whether or not it is smaller than the fixed value "b". If "YES", the guard value RFB is set as the fixed value "b" at step 910. The above-mentioned routine may be carried out at relatively long intervals, for example, every 500 ms.

Figure 10:
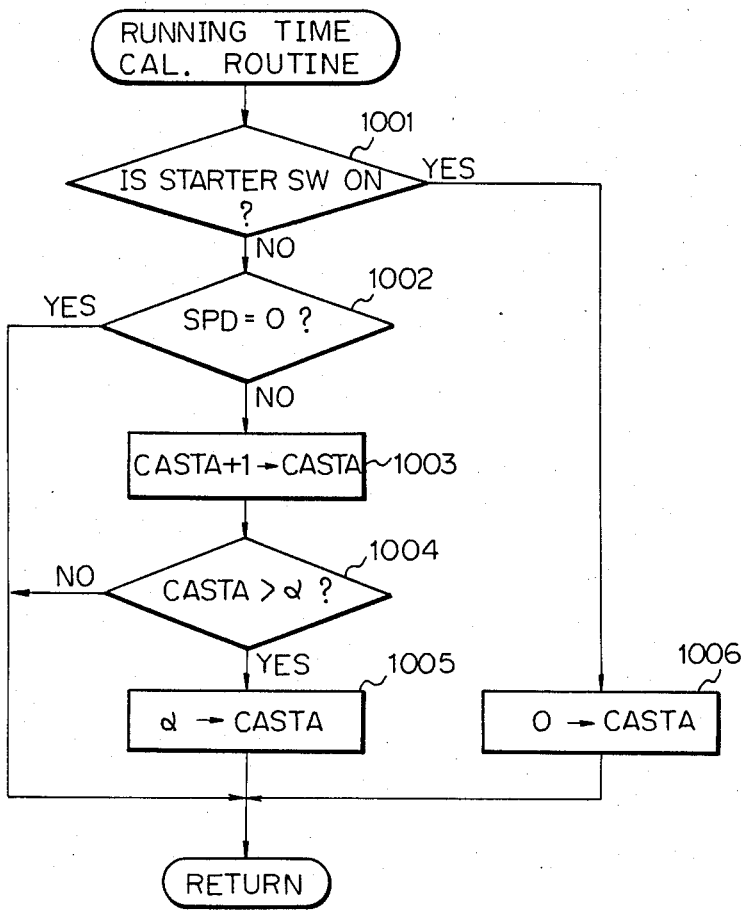

FIG. 10 is a routine for calculating the fixed running time α at step 901 shown in FIG. 9. In the routine shown in FIG. 10, it is determined at step 1001 whether or not the starter is turned ON. This determination may be made according to an ON signal which is taken in the I/O interface 102 when the key switch 15 (FIG. 5) is put in a starter position. This routine may be carried out at relatively long intervals, for example, every 500 ms.

If the starter is ON, the operation proceeds to step 1006 in which the count value CASTA of the counter for measuring the running period of time is set to zero. After starting the engine, the starter is turned OFF so that the operation may proceed from step 1001 to step 1002.

At step 1002, it is determined whether of not the vehicle has run after the start of the engine, according to the vehicle speed SPD taken from the I/O interface 102. If the vehicle speed SPD is zero (YES), i.e., if the vehicle has not been driven, the count value CASTA is not decreased. If SPD is not zero, because the vehicle has been driven, the routine proceeds to step 1003 in which the count value CASTA is increased. Steps 1004 and 1005 are provided for preventing an overflow of the counter. If the count value CASTA is equal to or smaller than α at step 1004, the count value CASTA remains as it is. If the count value CASTA is greater than α at step 1004, the count value CASTA is set to α at step 1005. In this way, the running time of the vehicle after the start of the engine is calculated to find the reference value α for step 901 shown in FIG. 9.

Figure 11:
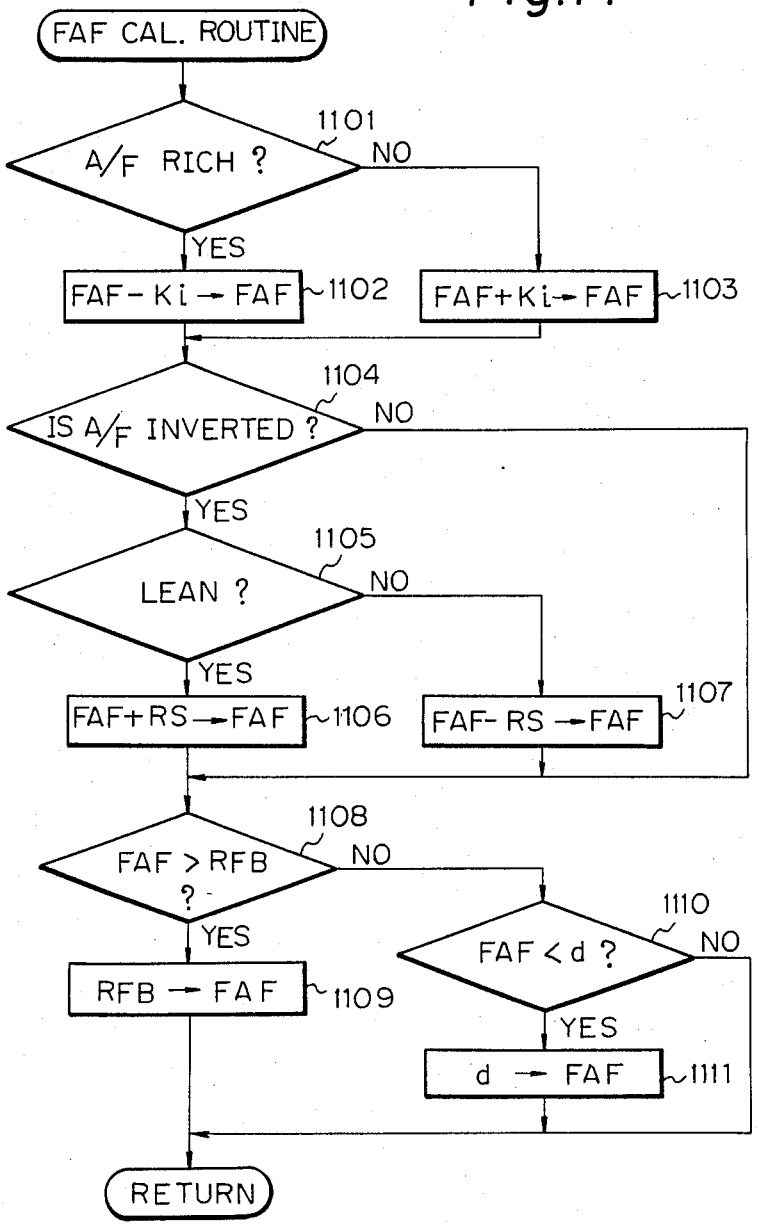

FIG. 11 is a routine used to calculate the air-fuel ratio correction coefficient FAF and to prevent the coefficient FAF from exceeding the upper limit guard value RFB and lower limit guard value LFB. Steps 1101 to 1107 are for calculating the air-fuel ratio correction coefficient FAF. If it is determined at step 1101 that the air-fuel ratio is lean, an integral processing is carried out at step 1103 by adding an integral constant "Ki" to the coefficient FAF, and if it is determined at step 1101 that the air-fuel ratio is rich, the integral processing is carried out at step 1102 by subtracting the integral constant Ki from the coefficient FAF. Namely, if the air-fuel ratio is lean, the fuel injection amount is gradually increased, and if the air-fuel ratio is rich, the fuel injection amount is gradually reduced.

At step 1104, it is determined whether or not the air-fuel ratio is inverted according to an output signal from the $O_2$ sensor. If the air-fuel ratio is inverted (YES), it is determined at step 1105 whether the inversion is from rich to lean, or from lean to rich. If the inversion is from rich to lean (YES), a skip process is carried out at step 1106. If the inversion is from lean to rich (NO), the skip process is carried out at step 1107. In the skip process, the air-fuel ratio correction coefficient FAF is skippingly increased or decreased by using a skip constant RS. If the air-fuel ratio is not inverted ("NO" at step 1104), the skip process is not carried out. The skip constant RS is set to be larger than the integral constant Ki.

Steps 1108 to 1111 are for performing a guard process when needed with respect to the air-fuel ratio correction coefficient FAF which has been obtained through the above-mentioned process. At step 1108, it is determined whether or not the air-fuel ratio correction coefficient FAF exceeds the variable upper limit guard value RFB, and, at step 1110, it is determined whether or not the coefficient FAF is smaller than a fixed value "d" which is a lower guard value LFB. If the air-fuel ratio correction coefficient FAF exceeds the upper limit guard value RFB ("YES" at step 1108), the coefficient FAF is set to the upper limit guard value RFB at step 1109. If the factor FAF is smaller than the lower limit guard value LFB ("NO" at step 1108 and "YES" at step 1110), the coefficient FAF is set to the lower limit guard value LFB at step 1111. If the air-fuel ratio correction coefficient FAF exists between the upper limit guard value RFB and the lower limit guard value LFB ("NO" at both steps 1108 and 1110), the coefficient FAF is not changed but remains as it is. This routine may be performed for, for example, every 4 ms.

The air-fuel ratio correction coefficient FAF thus calculated is stored in the RAM 105 of the controlling circuit 10.

Note that, when any one of the feedback control conditions is satisfied, the air-fuel ratio correction coefficient FAF is caused to be 1.0, that is, in the case, the routine of FIG. 11 is not carried out. The feedback control conditions are as follows:

(1) the engine is not in a starting state;

(2) the engine is not in a warming-up state, a fuel increasing state after startup, and the like;

(3) the engine is not in a fuel cut state;

(4) a change from the rich side to the lean side or vise versa has occurred in the output of the $O_2$ sensor.

Figure 12:
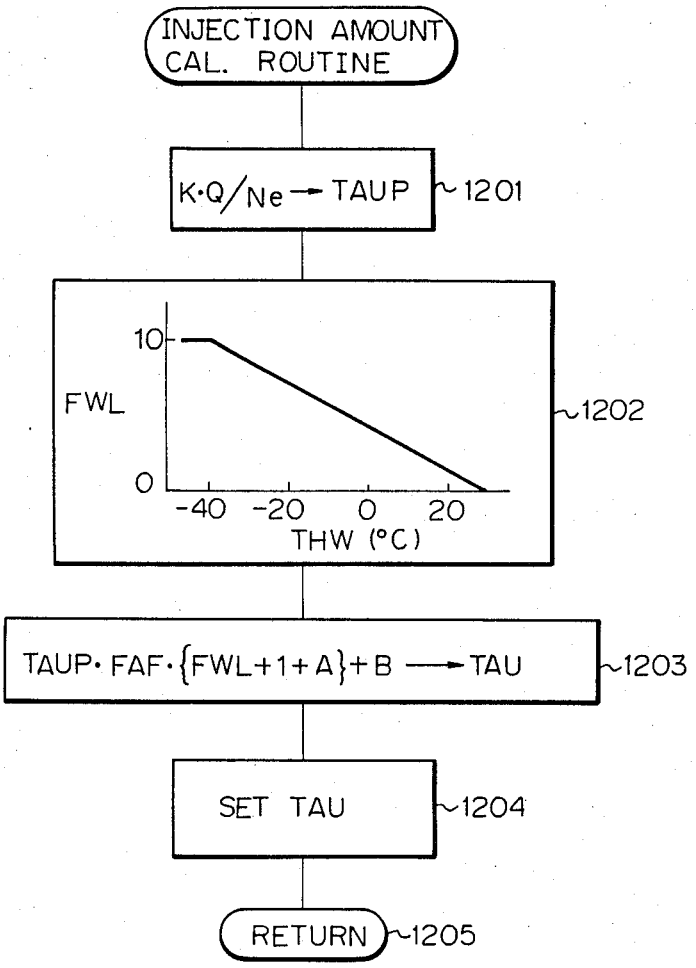

FIG. 12 is a routine for calculating a fuel injection amount to adjust the air-fuel ratio by using the air-fuel ratio correction coefficient FAF obtained according to the present invention. This routine is performed for every predetermined crank angle, for instance for every 360° of crank angle. At step 1201, data of the intake-air amount Q and the rotational speed Ne are read out from the ram 105 to calculate a basic injection amount TAUP according to, for example, the following formula:

$$TAUP \leftarrow KQ/Ne \text{ (K is a constant)}$$

At step 1202, the cooling water temperature data THW is read out from the RAM 105 to perform an interpolating calculation for a warm-up increment value FWL according to one dimensional map stored in the ROM 104. The warm-up increment FWL is set to be smaller as the cooling water temperature THW increases.

At step 1203, a final injection amount TAU is calculated as follows:

$$TAU \leftarrow TAUP \cdot FAF \cdot (FWL+1+A)+B$$

where, A and B are correction amounts determined by other operation parameters, for instance, a signal from a throttle position sensor (not shown), a signal from an intake-air temperature sensor, and a battery voltage which are stored in the RAM 105. At step 1204, the injection amount TAU is set to the down counter 108, and the flip-flop 109 is set to start the fuel injection. At step 1205, the routine is finished. As mentioned above, after the elapse of time corresponding to the injection amount TAU, the flip-flop 109 is reset by a carry-out signal of the down counter 108 so that the fuel injection may be terminated.

FIGS. 13A to FIG. 13H are timing chart for the supplemental explanation of the flowcharts shown in FIGS. 9 to 12. As shown in FIG. 13A to FIG. 13H, during a period of time starting from time $t_0$ at which the engine is started to time $t_1$, the upper guard value RFB is controlled to the fixed value "b" for a period of time during which the vehicle speed SPD is not equal to zero and until the count value CASTA reaches to the predetermined value $\alpha$. During a period of time from time $t_1$ to time $t_2$, although the state of SPD$\neq$0 is maintained as it is, the upper limit guard value RFB is kept at the fixed value "b" because the engine rotational speed Ne does not reach the predetermined value "a".

If the engine rotational speed Ne exceeds the predetermined value "a" at time $t_2$, the upper limit guard value RFB is gradually increased, and at time $t_3$ the upper limit guard value RFB reaches a predetermined value "c" which is maintained thereafter. If the engine rotational speed Ne is below the predetermined value "a" at time $t_4$, the upper limit guard value RFB is gradually decreased, and, at time $t_5$, the value RFB reaches the predetermined value "b" which is maintained thereafter. In this way, when the engine rotational speed Ne is decreased, the temperature of the $O_2$ sensor is also decreased so that the $O_2$ sensor may become inactive gradually. After time $t_6$, the engine rotational speed Ne again exceeds the predetermined value "a" so that the upper limit guard value RFB may be gradually increased to the predetermined value "c".

As mentioned above, the upper limit guard value RFB is kept at the fixed value "b" during the period of time from $t_5$ to $t_6$ according to the present invention so that, within this period, the air-fuel ratio correction coefficient FAF may be guarded so that it does not exceed the value RFB (equal to "b").

Figures 13A, 13B, 13C, 13D, 13E, 13F:
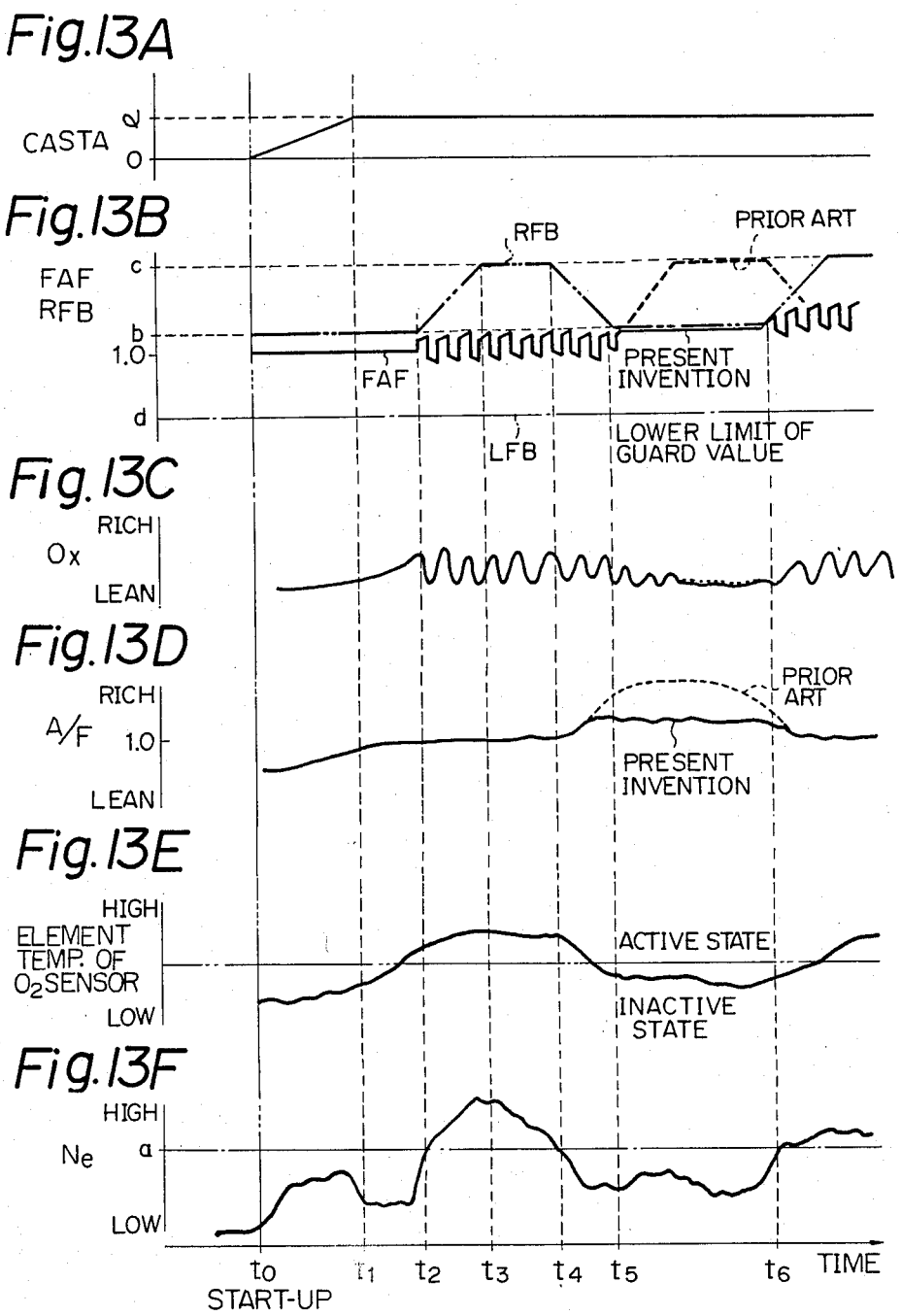
FIGS. 13A, 13B, 13C, 13D, 13E, and 13F are timing charts supplemental to the flowcharts shown in FIGS. 9, 10, 11, and 12.

In a prior art technique, which is indicated by a dot line in FIGS. 13B and 13D, the air-fuel ratio feedback control is performed when the output signal of the $O_2$ sensor 13 (correctly, the output signal of the processing circuit) decreases so that the air-fuel ratio correction coefficient FAF may be increased to cause an erroneous correction of the air-fuel ratio.

According to the present invention, within the period in which the $O_2$ sensor is in an inactive state, the air-fuel ratio A/F, which has changed to a rich side in the prior art as indicated by the dot line, is suppressed as indicated by a continuous line so that the air-fuel ratio A/F may be prevented from becoming over-rich.

Although the explanation has been made for the flow-out type output processing circuit adopted for the $O_2$ sensor, the present invention will be applicable to the flow-in type circuit for the $O_2$ sensor in which the air-fuel ratio is prevented from becoming over-lean by changing the guard value LFB on the lean side when the $O_2$ sensor is inactive.

In the above explanation, the present invention has been applied to an engine in which air-fuel ratio is controlled only by the air-fuel ratio correction coefficient through the feed back control. The air-fuel ratio feedback control of the engine may be carried out by introducing a learning quantity in addition to the air-fuel ratio correction coefficient. In the air-fuel ratio feedback control with the learning control, if it is intended to stop the feedback control by changing the guard value of the air-fuel ratio correction coefficient FAF, the feedback control will not be actually stopped, because the change of the air-fuel ratio has an influence on the learning quantity.

Therefore, for the engine which is controlled by the air-fuel ratio feedback control with the learning control, the learning control must be stopped under a predetermined operating condition of the engine when the guard value of the air-fuel ratio correction coefficient FAF is changed. The operation of a controlling circuit according to the present invention for such an engine will now be described.

In the engine which performs the air-fuel ratio feedback control with the learning control, the air-fuel ratio correction coefficient FAF is guarded with the upper limit guard value RFB (when the $O_2$ sensor is one of the flow-out type) according to the operating condition of the engine. The calculation of the guard value RFB is performed in the same manner as that explained before for the engine which does not perform the learning control. Namely, the calculation routine for the upper limit guard value RFB is the same as that shown in FIG. 9, and the calculation routine for the running time after the start of the engine is the same as that shown in FIG. 10.

Figure 14:
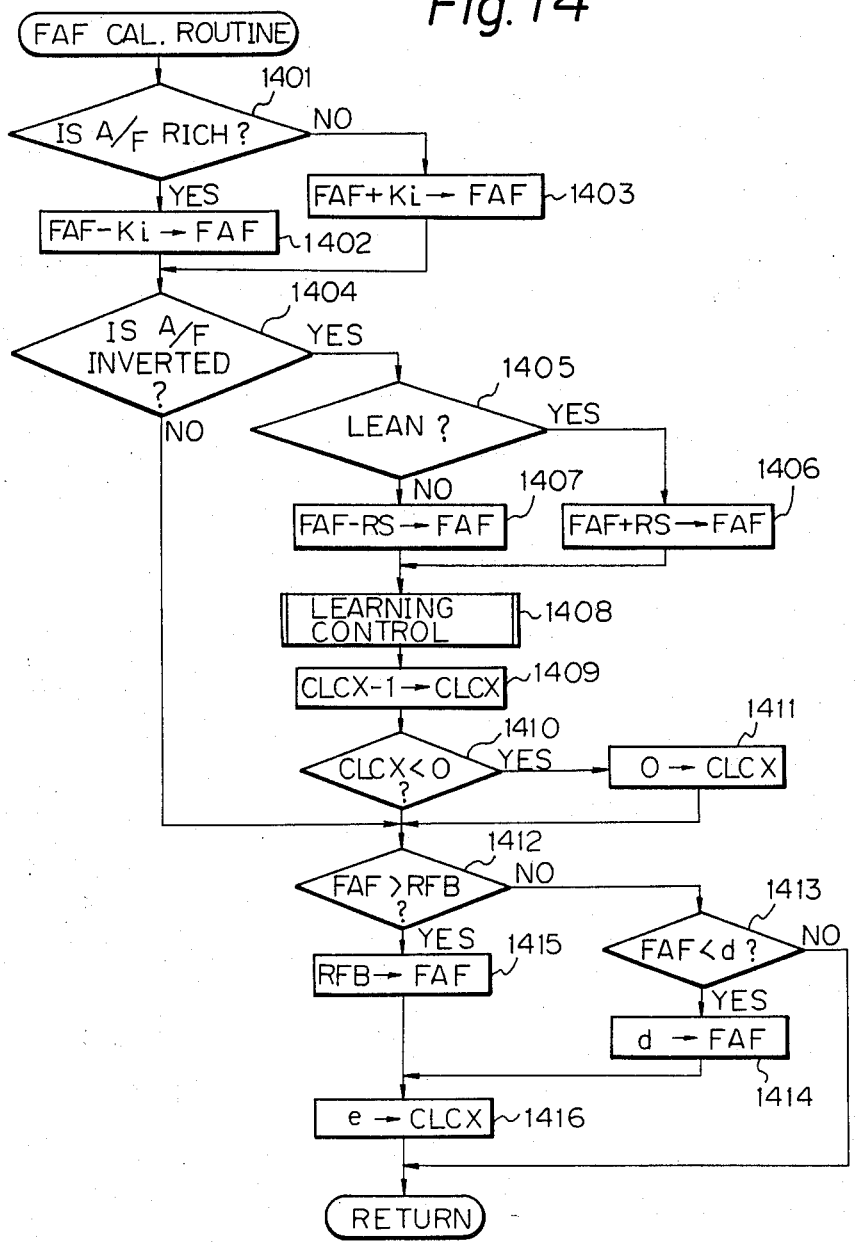

For the engine which performs the learning control, the upper and lower limit guard is performed by calculating the air-fuel ratio correction coefficient FAF, and when the variable guard value of the air-fuel ratio correction coefficient FAF is close to a control center value "1.0", the learning control of the base air-fuel ratio is inhibited because in such a case, it is a highly possible that the $O_2$ sensor is in an inactive state. This routine is shown in FIG. 14.

At steps 1401, 1402, and 1403, an integration process is carried out by adding or by subtracting an integration constant Ki for a case in which the air-fuel ratio is rich and for a case in which the air-fuel ratio is lean, separately. At step 1404, it is determined whether or not the air-fuel ratio is inverted. If not inverted (NO), the operation proceeds to step 1412, and if inverted (YES), to step 1405. At steps 1405, 1406, and 1407, a skipping process using a skip constant RS is performed depending on the direction of the inversion of the air-fuel ratio. After that, a learning control is carried out at step 1408.

After the completion of the learning control process, the operation proceeds to step 1409 in which the value of a learning control inhibit counter CLCX necessary for a learning control process (to be explained later) is decreased. Steps 1401 and 1411 hold the value of the counter CLCX at zero when the value of the counter CLCX which has been decreased at step 1409 is negative.

After that, step 1412 is carried out to perform a guard process in which the air-fuel ratio correction coefficient FAF is guarded if it exceeds the upper and lower guard values, and not changed if it is between the upper and lower limit values. Only when the air-fuel ratio correction coefficient FAF is guarded at steps 1414 and 1415, does the operation proceed to step 1416, in which the learning control inhibit counter CLCX is set to an initial value "e" to finish the routine. This routine may be carried out, for example, every 4 ms.

Figure 15:
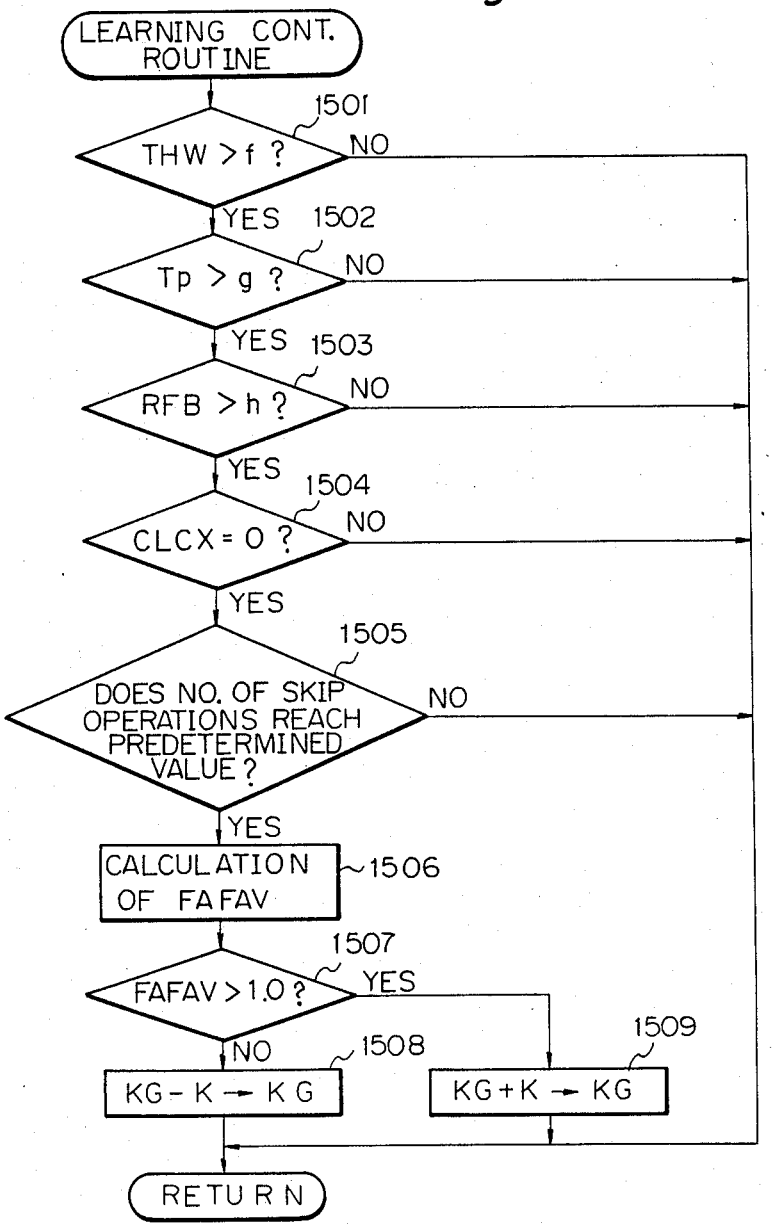

FIG. 15 is a detailed routine of the learning control process performed at step 1408 shown in FIG. 14. At steps 1501 to 1504, it is determined whether or not the executing conditions of the learning control are met, and only when the conditions are met, is the learning control performed at steps 1505 to 1509. To execute the learning control, all of the following conditions must be met:

(1) The water temperature THW must be higher than a value "f".

(2) A basic injection pulse width Tp must be greater than a value "g".

(3) The upper limit guard value RFB for the air-fuel ratio correction coefficient FAF must be greater than a value "h" ($h>b$).

(4) The value of the learning control inhibit counter CLCX must be zero.

When all of the above conditions are satisfied, i.e., all "YES" at steps 1501 to 1504, the operation proceeds to step 1505. Other conditions may be added to the above conditions when needed.

According to the learning control, an average value FAFAV of the air-fuel ratio correction coefficient FAF is controlled to a predetermined value "1.00". At step 1505, it is determined whether or not the air-fuel ratio correction coefficient FAF skips for a predetermined number to calculate the average value. If it is determined at step 1505 that the number of skips exceeds the predetermined number, the operation proceeds to step 1506 in which the average value FAFAV of the air-fuel ratio correction coefficient FAF just before the skip of the predetermined number is calculated.

Steps 1507 to 1509 are for correcting the learning quantity such that the average value FAFAV is converged to 1.00. Namely, if the average value FAFAV exceeds 1.00 at step 1507, a learning control value KG is increased by a predetermined value K at step 1509 to increase the fuel injection amount. If the average value FAFAV is less than 1.00, the learning control value KG is reduced by the predetermined value K at step 1508 to reduce the fuel injection amount. The learning control value KG thus obtained is stored in the backup RAM 106. The average value FAFAV may be converged, for example, to 1.02 to 0.98.

Figure 16:
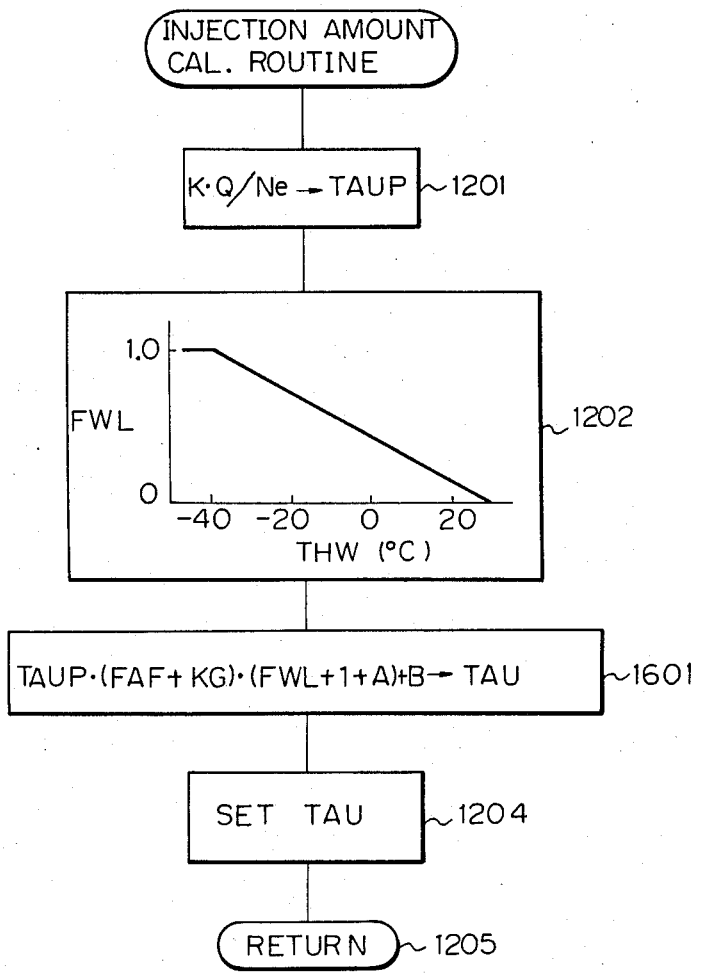
Figures 17A, 17B, 17C, 17D, 17E, 17F, 17G, 17H:
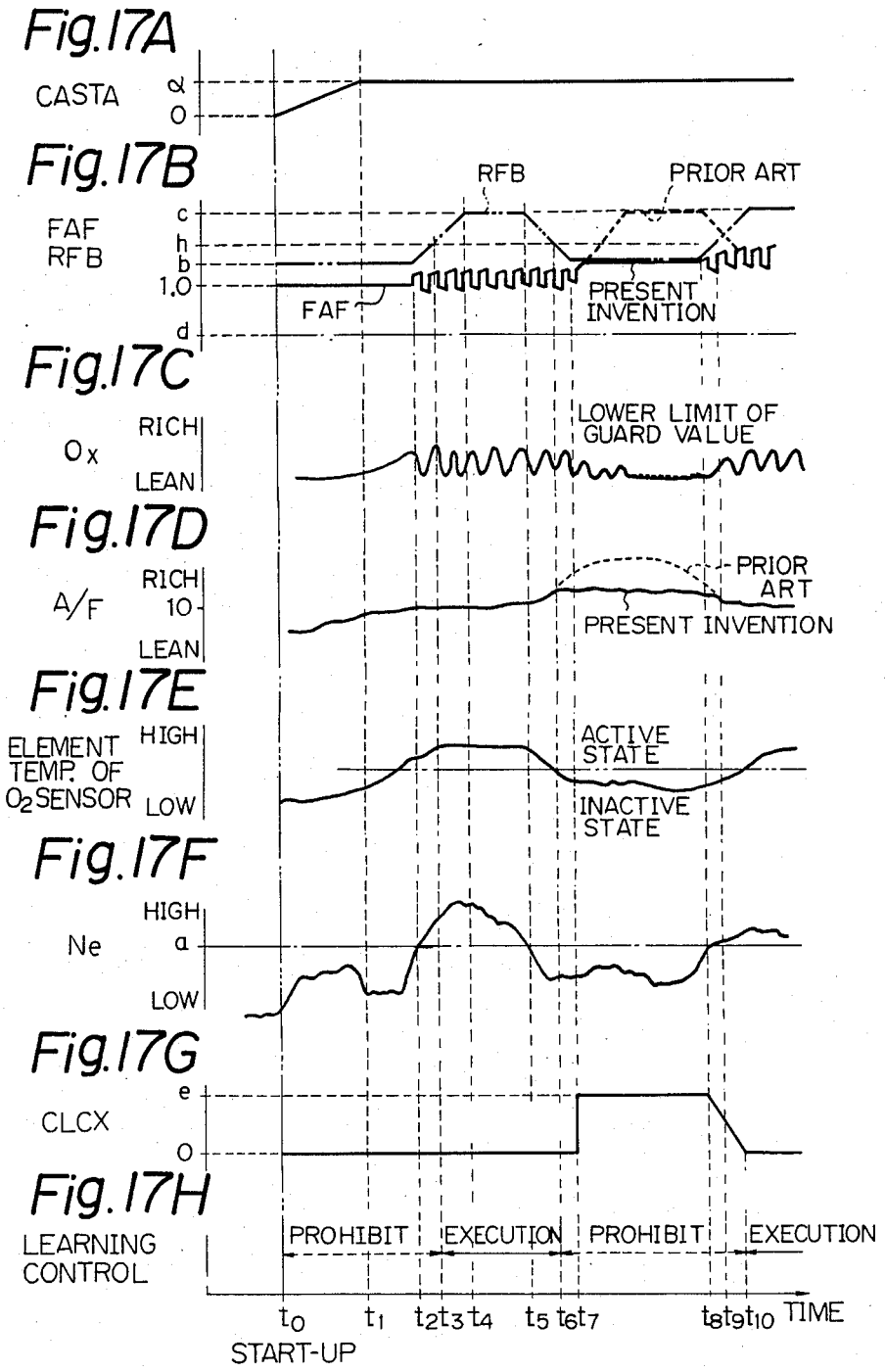
FIGS. 17A, 17B, 17C, 17D, 17E, 17F, 17G, and 17H are timing charts supplemental to the flowcharts shown in FIGS. 14, 15, and 16.

FIG. 16 is an injection amount calculating routine used to adjust the air-fuel ratio by using the air-fuel ratio correction coefficient FAF and the learning control value KG obtained according to the present invention. This routine is performed at every predetermined crank angle, for instance, 360°. Except for step 1601, all steps in this routine are the same as those shown in FIG. 12. Therefore, the same steps are represented by the same reference numerals as those shown in FIG. 12, and an explanation thereof will be omitted.

At step 1601, a final fuel injection amount TAU is calculated as follows:

$$TAU \leftarrow TAUP \cdot (FAF+KG) \cdot (FWL+1+A)+B$$

where A and B are correction amounts determined by other operation parameters such as a signal from a throttle position sensor (not shown), a signal from the intake-air temperature sensor, and a battery voltage which are stored in the RAM 105.

FIGS. 17A, 17B, 17C, 17D, 17E, 17F, 17G, and 17H are timing chart for the supplemental explanation of the flowcharts shown in FIGS. 9, 10, and 14 to 16.

As shown in FIGS. 17A to 17H, during a period of time starting from time $t_0$ at which the engine is started to time $t_1$, the upper guard value RFB is controlled to the fixed value "b" for a period of time during which the vehicle speed SPD is not equal to zero and until the count value CASTA reaches the predetermined value $\alpha$. During a period of time from time $t_1$ to time $t_2$, although the state of SPD≠0 is maintained as it is, the upper limit guard value RFB is kept at the fixed value "b" because the engine rotational speed Ne does not reach the predetermined value "a". Since the upper limit guard value RFB is smaller than "h", the learning control is naturally in an inhibited state.

If the engine rotational speed Ne exceeds the predetermined value "a" at time $t_2$, the upper limit guard value RFB is gradually increased, and at time $t_3$ when the upper limit guard value RFB exceeds a predetermined value "h" under the conditions that the engine water temperature THW is higher than "f" and the basic injection pulse width Tp greater than "g", the learning control is executed. When the upper limit guard value RFB reaches a predetermined value "c" at time $t_4$, the upper limit value RFB is maintained as it is thereafter.

If the engine rotational speed Ne drops below the predetermined value "a" at time $t_5$, the upper limit guard value RFB is gradually reduced, and, at time $t_7$, the value RFB reaches the predetermined value "b" which is maintained until the engine rotational speed Ne exceeds the predetermined value "a" at time $t_8$. Since the upper limit guard value RFB reaches the predetermined value "h" at time $t_6$ before time $t_7$, the learning control is inhibited at time $t_6$.

In this way, when the engine rotational speed Ne is decreased, the temperature of the $O_2$ sensor is also decreased so that the $O_2$ sensor may gradually become inactive. As a result, an output $O_x$ of the output processing circuit of the $O_2$ sensor stays on the lean side. Although the air-fuel ratio correction coefficient FAF is increased, the upper limit guard value RFB is kept at the fixed value "b" during the period of time from $t_7$ to $t_8$ so that the air-fuel ratio correction coefficient FAF may be guarded so that it does not exceed "b". (In a prior art technique, the coefficient FAF changes as indicated by a dot line in FIG. 17B, so that the air-fuel ratio A/F may be over-rich as indicated by a dot line in FIG. 17D.)

When the engine rotational speed Ne exceeds the predetermined value "a" at time $t_8$, the upper limit guard value RFB is gradually increased so that the value of the learning control inhibit counter CLCX may be decreased. At time $t_9$, the upper limit guard value RFB exceeds the predetermined value "h". At this time, however, the value of the learning control inhibit counter CLCX is not yet zero so that the learning control may not be carried out in the learning control process routine until the value of the learning control inhibit counter CLCX reaches zero at time $t_{10}$. Namely, even if the guard value meets the condition for starting the learning control, the learning control will not be carried out until the output signal of the $O_2$ sensor is inverted for a predetermined number to prevent an erroneous learning control. Subsequently, the upper limit guard value RFB is increased to the maximum value "c" which is maintained as it is thereafter.

As described above, according to the present invention with the learning control, the learning control is inhibited when the upper limit guard value RFB of the air-fuel ratio correction coefficient FAF is smaller than a predetermined value, when the coefficient FAF is guarded by the upper limit guard value RFB, and when a predetermined period of time has not passed after the completion of the guard of the air-fuel ratio correction coefficient FAF by the upper guard value RFB. Therefore, an erroneous learning control is prevented, and thus an erroneous control in the air-fuel ratio feedback control prevented.

Although the explanation has been made for the flow-out type output processing circuit adopted for the $O_2$ sensor, the present invention is also applicable to a flow-in type $O_2$ sensor for which, by using the lower limit guard value LFB as the variable guard value, the control of the air-fuel ratio correction coefficient FAF and the inhibition of the learning control will be carried out in the same manner as for the flow-out type $O_2$ sensor.

The system of the present invention can be realized at a low cost with a simple structure in comparison with a prior art $O_2$ sensor provided with a heater for preventing the sensor from being cooled.

I claim:

1. A method for controlling an air-fuel ratio in an internal combustion engine having an air-fuel ratio sensor provided in an exhaust pipe for detecting an air-fuel ratio thereof and a signal processing circuit of a flow-in type for processing an output of said air-fuel ratio sensor, comprising the steps of:

receiving said output of said air-fuel ratio sensor and calculating an air fuel ratio correction amount in accordance with the detected air-fuel ratio, so that the air-fuel of said engine is brought close to a predetermined air-fuel ratio;

detecting a running state parameter of said engine;

setting an upper limit value of said air-fuel ratio correction amount at a definite value;

calculating a lower limit value of said air-fuel ratio correction amount in accordance with said running state parameter;

defining a range between a maximum value and a minimum value of said lower limit value;

limiting said lower limit to within said range;

limiting said air-fuel ratio correction amount to within a second range defined between said upper limit value and said lower limit value; and adjusting an air-fuel ratio of said engine in accordance with the air-fuel ratio correction amount.

2. A method as set forth in claim 1, wherein said running state parameter detecting step comprises the steps of:

detecting the state of an idle switch; and detecting the engine rotational speed.

3. A method as set forth in claim 1, further comprising the steps of:

calculating an learning correction amount so that a mean value of said air-fuel correction amount is brought close to a predetermined value;

adjusting the air-fuel ratio of said engine in accordance with said air-fuel ratio correction amount and said learning correction amount; and inhibiting the calculation of said learning correction amount for a predetermined time period after said lower limit value reaches said maximum value.

4. A method as set forth in claim 1, further comprising a step of setting said lower limit value at a predetermined value until a vehicle, on which said engine is mounted, is driven for a predetermined time or for a predetermined distance after said engine is started.

5. A method for controlling an air-fuel ratio in an internal combustion engine having an air-fuel ratio sensor provided in an exhaust pipe for detecting an air-fuel ratio thereof and a signal processing circuit of a flow-out type for processing an output of said air-fuel ratio sensor, comprising the steps of:

calculating an air-fuel ratio correction amount in accordance with the detected air-fuel ratio so that the air-fuel ratio of said engine is brought close to a predetermined air-fuel ratio;

detecting a running state parameter of said engine;

setting a lower limit value of said air-fuel ratio correction amount at a definite value;

calculating an upper limit value of said air-fuel correction amount in accordance with said running state parameter;

defining a range between a maximum value and a minimum value of said upper limit value;

limiting said upper limit to said range;

limiting said air-fuel ratio correction amount to a second range defined between said upper limit value and said lower limit value; and adjusting an air-fuel ratio of said engine in accordance with the air-fuel ratio correction amount.

6. A method a set forth in claim 5, wherein said running state parameter detecting step comprises the steps of:

detecting the state of an idle switch; and detecting the engine rotational speed.

7. A method as set forth in claim 5, further comprising the steps of:

calculating an learning correction amount so that a mean value of said air-fuel correction amount is brought close to a predetermined value;

adjusting the air-fuel ratio of said engine in accordance with said air-fuel ratio correction amount and said learning correction amount; and inhibiting the calculation of said learning correction amount for a predetermined time period after said upper limit value reaches said minimum value.

8. A method as set forth in claim 5, further comprising a step of setting said upper limit value at a predetermined value until a vehicle, on which said engine is mounted, is driven for a predetermined time or for a predetermined distance after said engine is started.

9. An apparatus for controlling an air-fuel ratio in an internal combustion engine having an air-fuel ratio sensor provided in an exhaust pipe for detecting an air-fuel ratio thereof and a signal processing circuit of a flow-in type for processing an output of said air-fuel ratio sensor, comprising:

means for calculating an air-fuel ratio correction amount in accordance with a detected air-fuel ratio so that the air-fuel ratio of said engine is brought close to a predetermined air-fuel ratio;

means for detecting a running state parameter of said engine;

means for setting an upper limit value of said air-fuel correction amount at a definite value;

means for calculating a lower limit value of said air-fuel ratio correction amount in accordance with said running state parameter;

means for defining a range between a maximum value and a minimum value of said lower limit value;

means for limiting said lower limit to said range;

means for limiting said air-fuel ratio correction amount within a second range defined between said upper limit value and said lower limit value; and means for adjusting an air-fuel ratio of said engine in accordance with the air-fuel ratio correction amount.

10. An apparatus as set forth in claim 9, wherein said running parameter detecting means comprises:

means for detecting the state of an idle switch; and means for detecting the engine rotational speed.

11. An apparatus as set forth in claim 9, further comprising:

means for calculating an learning correction amount so that a mean value of said air-fuel correction amount is brought close to a predetermined value;

means for adjusting the air-fuel ratio of said engine in accordance with said air-fuel ratio correction amount and said learning correction amount; and means for inhibiting the calculation of said learning correction amount for a predetermined time period after said lower limit value reaches said maximum value.

12. An apparatus as set forth in claim 9, further comprising means for setting said lower limit value at a predetermined value until a vehicle, on which said engine is mounted, is driven for a predetermined time or for a predetermined distance after said engine is started.

13. An apparatus for controlling an air-fuel ratio in an internal combustion engine having an air-fuel ratio sensor provided in an exhaust pipe for detecting an air-fuel ratio thereof and a signal processing circuit of a flow-out type for processing an output of said air-fuel ratio sensor, comprising:

means for calculating an air-fuel ratio correction amount in accordance with a detected air-fuel ratio so that the air-fuel ratio of said engine is brought close to a predetermined air-fuel ratio;

means for detecting a running state parameter of said engine;

means for setting a lower limit value of said air-fuel ratio correction amount at a definite value;

means for calculating an upper limit value of said air-fuel ratio correction amount in accordance with said running state parameter;

means for defining a range between a maximum value and a minimum value of said upper limit value;

means for limiting said upper limit value to said range;

means for limiting said air-fuel ratio correction amount to a second range defined between said upper limit value and said lower limit value; and means for adjusting an air-fuel ratio of said engine in accordance with the air-fuel ratio correction amount.

14. An apparatus as set forth in claim 13, wherein said running state parameter detecting step comprises the steps of:

means for detecting the state of an idle switch; and means for detecting the engine rotational speed.

15. An apparatus as set forth in claim 13, further comprising:

means for calculating an learning correction amount so that a mean value of said air-fuel correction amount is brought close to a predetermined value;

means for adjusting the air-fuel ratio of said engine in accordance with said air-fuel ratio correction amount and said learning correction amount; and means for inhibiting the calculation of said learning correction amount for a predetermined time period after said upper limit value reaches said minimum value.

16. An apparatus as set forth in claim 13, further comprising means for setting said upper limit value at a predetermined value until a vehicle, on which said engine is mounted, is driven for a predetermined time or for a predetermined distance after said engine is started.

* * * * *